United States Patent [19]

Langhoff et al.

[11] Patent Number: 5,045,179

[45] Date of Patent: Sep. 3, 1991

[54] PROCESS FOR THE HYDROGENATION REPROCESSING OF USED OILS

[75] Inventors: Josef Langhoff, Dinslaken; Alfons Jankowski, Essen; Harald Weber, Duisburg-Rahm, all of Fed. Rep. of Germany

[73] Assignee: Ruhrkohle AG, Essen, Fed. Rep. of Germany

[21] Appl. No.: 220,139

[22] Filed: Jul. 15, 1988

[30] Foreign Application Priority Data

Jul. 17, 1987 [DE] Fed. Rep. of Germany ..... 3723607

[51] Int. Cl.[5] ..... C10M 11/00

[52] U.S. Cl. ..... 208/262.5; 208/262.1; 208/177; 208/181; 208/184; 208/185; 208/142; 210/909; 585/469

[58] Field of Search ..... 208/262.1, 262.5, 181, 208/183, 184, 185, 142, 179; 585/469

[56] References Cited

U.S. PATENT DOCUMENTS

| | | | |
|---|---|---|---|
| 3,346,483 | 10/1967 | Somogyi et al. | 208/183 |
| 3,913,076 | 11/1975 | Cutler | 208/179 |
| 4,017,425 | 4/1977 | Shiao | 502/235 |
| 4,151,072 | 4/1979 | Nowack et al. | 208/182 |
| 4,272,359 | 6/1981 | Owen | 208/179 |
| 4,287,049 | 9/1981 | Tabler et al. | 208/181 |
| 4,431,524 | 2/1984 | Norman | 208/181 |
| 4,464,479 | 8/1984 | Ritter et al. | 502/185 |
| 4,512,878 | 4/1985 | Reid et al. | 208/184 |
| 4,522,729 | 6/1985 | Tabler | 210/727 |
| 4,559,129 | 12/1985 | Reynolds et al. | 208/89 |
| 4,559,130 | 12/1985 | Reynolds | 208/89 |
| 4,623,448 | 11/1986 | O'Connell et al. | 208/182 |

FOREIGN PATENT DOCUMENTS

| | | | |
|---|---|---|---|
| 1136650 | 3/1977 | Japan | 585/469 |

*Primary Examiner*—Helane E. Myers

*Attorney, Agent, or Firm*—Nils H. Ljungman & Associates

[57] ABSTRACT

The present invention provides a hydrogenation process for reprocessing used oil into secondary raffinates in the form of lubricating oils. In this process according to some embodiments of the invention, ecologically undesirable byproducts or waste materials are eliminated, without requiring expensive and time-consuming separation stages or reaction conditions, or the use of expensive catalysts. In particular, even severely contaminated oils, i.e. those which contain organo-chlorine compounds, in particular PCB, chlorinated dioxins and dibenzofurane in concentrations above certain limits, can also be reused as secondary raffinates, in particular as lubricating oils. No longer need these substances be destroyed in a high temperature combustion process, for example. As a first step, the coarse solid substances are removed from the used oil. Thereafter, with the addition of hydrogen, a hydrogenation step is conducted in a sump phase at predetermined pressures and temperatures. Then the reaction products are separated into the lubricating oil and byproducts containing solids.

23 Claims, 2 Drawing Sheets

PROCESS FOR THE HYDROGENATION REPROCESSING OF USED OILS

BACKGROUND OF THE INVENTION

1. Field of the Invention

This invention relates, in general, to reclaiming used oil and, more particularly, the invention relates to a hydrogenation process for reprocessing of used oils into secondary raffinates which are in the form of lubricating oils and other byproducts with the addition of hydrogen.

2. Description of the Prior Art

It is known, for example, that in West Germany alone, approximately 500,000 t of used oils are produced each year. In that country, that amount represents approximately 50% of the new oil used in the same time period. It can be assumed that this percentage of used oil to new oil used would be similar in the other major countries throughout the world. If that assumption is correct, it can be seen that vast quantities of used oil are produced each year. The majority of the used oil, at least in West Germany, is processed into so-called secondary raffinates. In the processes presently available, however, u for the processing of used oil into secondary raffinates, they require that the used oil be contaminated only to an extremely small degree with substances which could possibly lead to some degree of environmental damage when the secondary raffinates produced in these presently available processes are reused. The organo-chlorine compounds found in much of the used oils are particularly harmful, in particular PCB (polychlorinated biphenyl). These organo-chlorine contaminants can be the source of the highly-toxic chlorinated dibenzodioxins and dibenzofurane. This is particularly the case if the secondary raffinates containing these contaminates are burned at low temperature. One example of such low temperature burning is the use of the secondary raffinates as a lubricating oil in an internal combustion engine. Polychlorinated biphenyls are used, for example, in cutting oils and hydraulic oils, particularly in the mining industry. Polychlorinated biphenyls are also present in coolant oils that are used in transformers because that makes such coolant oil non-combustible.

It is known in the art that PCB's cannot be microbiologically decomposed. Furthermore, such PCB's are persistent and ubiquitous. Polychlorinated biphenyls have a chemical structure that is similar to DDT (dichlorodiphenyltrichloroethane) and are also found increasingly in the food chain. For example, they are found in fish, milk, etc. Oils that are contaminated in this or in a similar manner and which contain more than 20 mg/kg PCB and/or more than 0.5 wt.% organochlorine compounds are considered harmful waste products. Therefore, such contaminated oils are subject to special requirements concerning waste disposal. In the future, it is expected that the permissible limits on these oil contaminates will be reduced even further. Prior to the present invention, used oils with a level of contamination above these values had to be disposed of as special waste. For this purpose, a special waste disposal facility must be provided. An example of such waste disposal facility suitable for this purpose is a high temperature combustion installation. The capacity of such installations presently available in West Germany, for example, is altogether inadequate. Consequently, at the present time, there are bottlenecks encountered in the disposal process. In a high temperature combustion installation, the used oil is burned at temperatures above 1200° C. and generally with hold times of greater than 0.3 seconds, to reduce the production of toxic substances. One example of such toxic substance is dioxin, a known cancer-causing compound.

Even the reprocessing of uncontaminated or only slightly contaminated used oils has been problematic prior to this invention. The sulfuric acid-clay process, for example, which is in itself appropriate for the production of secondary raffinates, also produces an acid resin which is an ecologically objectional residue.

This known disadvantage of the sulfuric acid-clay process was reduced by the KTI process. According to the KTI process, the used oil is first subjected to a physical treatment and thereafter to a so-called hydrofinishing. The physical treatment portion of the process comprises a multi-stage purification process. In a first stage of the purification process, water and easily volatile components are separated from the used oil at atmospheric pressure and at a temperature of 150° C. Then, in a second stage of the purification process, a gas oil fraction is extracted in a vacuum of 20 mbar and a temperature of 270° C. This is followed by a third stage which consists of a high-vacuum flash distillation. Such high-vacuum flash distillation is conducted in a specially designed thin-film evaporator. The thin-film evaporator is operated, at a temperature of 310° C. and a vacuum of 2 mbar, with the use of indirect heat exchange and simultaneous high turbulence in the heat exchange zones. In the KTI process, heavy components of the used oil are extracted as an asphalt-like residue. Such heavy components in the used oil generally include additives, metals and decay products. The fourth stage is the hydro- finishing. In such hydrofinishing state, the only contaminants contained in the purified oil fraction are those contaminated which have the same boiling range as the purified oil fraction itself. These contaminants primarily include components which contain chlorine, oxygen and nitrogen. The hydrofinishing stage of the KTI process is conducted at pressures of approximately 50 bar and temperatures between 300° and 350° C. In this manner, the impurities are extracted as ammonium chloride, gas oil and water. In addition, any sulfur impurities which may be present in the used oil would be removed as $H_2S$. The presence of organochlorine compounds or ethylene glycol (from antifreeze), however, has a negative impact on the process. The reason being that these substances increase the hydrogen consumption, contaminate the catalyst more rapidly, and also require the use of special catalyst.

SUMMARY OF THE INVENTION

It is, therefore, one of the primary objects of the present invention to provide a hydrogenation process for reprocessing used oil into secondary raffinates in the form of lubricating oil.

Another object of the present invention is to provide a hydrogenation process for reprocessing used oil into secondary raffinates which substantially avoids the production of ecologically undesirable byproducts and/or other harmful wastes.

Still another object of the present invention is to provide a hydrogenation process for reprocessing used oil into secondary raffinates in which it is possible to reprocess even those oils which contain certain organochlorine compounds and PCB in particular.

Yet another object of the present invention is to provide a hydrogenation process for reprocessing used oil into secondary raffinates which substantially minimizes the need for special waste disposal facilities.

A further object of the present invention is to provide a hydrogenation process for reprocessing used oil which in contrast to high temperature combustion, in which such used oil is destroyed, the products produced according to the invention by means of hydrogenating dechlorination, can be economically reused as secondary raffinates.

An additional object of the present invention is to provide a hydrogenation process for reprocessing used oil into secondary raffinates in which the typical product characteristics of a lubricating oil are substantially retained.

It is another object of the present invention to provide a hydrogenation process for reprocessing used oil into secondary raffinates in which the process can also be used for the hydrogenation reprocessing of uncontaminated oil without producing ecologically harmful and/or objectionable byproducts and/or harmful wastes such as those produced by the sulfuric acid-clay process.

Still another object of the present invention is to provide a hydrogenation process for reprocessing used oil into secondary raffinates in which so-called aging products present in the used oil can be easily removed from such used oil as well as any additives which may be present therein.

Yet another object of the present invention is to provide a hydrogenation process for reprocessing used oil into secondary raffinates which allows the separation of the used oil into residues and product oil with the use of relatively economical catalysts.

It is a further object of the present invention to provide a hydrogenation process for reprocessing used oil into secondary raffinates that is less expensive than processes know in the prior art, e.g., the KTI process.

An additional object of the present invention is to provide a hydrogenation process for reprocessing used oil into secondary raffinates which can have a significant impact on the conservation of one of the world's most import national resources.

In summing up, one aspect of the invention resides broadly in a process for removing polycholorinated biphenyl from at least one of hydraulic fluid, cutting oil and electric transformer coolant oil, the process comprising the steps of:

(a) removing any coarse solid particles from at least one of the hydraulic fluid, the cutting oil and the electric transformer coolant oil;

(b) adding a predetermined amount of hydrogen to at least one of the hydraulic fluid, the cutting oil and the electric transformer coolant oil after the immediately preceding removing step to form a hydrogen rich mixture;

(c) preheating the hydrogen rich mixture performed in the immediately preceding adding step to a predetermined temperature:

(d) passing the hydrogen rich mixture preheated to the predetermined temperature in the immediately preceding preheating step to a sump phase reactor;

(e) hydrogenating the hydrogen rich mixture in the sump phase reactor at a predetermined pressure and a predetermined temperature to form a combination of reaction products;

(f) heating the reaction products formed in the immediately preceding hydrogenating step to a hot separator;

(g) separating the reaction products in the hot separator into gaseous liquid and solid products;

(h) extracting the gaseous products from an upper portion of the hot separator;

(i) extracting the liquid and the solid product from a lower portion of the hot separator;

(j) passing the liquid and the solid product extracted from the hot separator in immediately preceding extracting step to a vacuum distillation tower; and (k) separating the liquid and the solid at a predetermined temperature and a predetermined pressure in the vacuum distillation tower into a liquid portion and a pumpable solids portion containing the polychlorinated biphenyl.

Another aspect of the invention resides broadly in a hydrogenation process for reprocessing a previously used oil into secondary raffinates as a lubricating oil, the process comprising the steps of:

(a) removing substantially all coarse solid substances from the used oils which may be present therein;

(b) subjecting the used oils obtained in the immediately preceding removing step to hydrogenation in a sump phase reactor, the sump phase reactor being operated at a predetermined pressure and a predetermined temperature; and (c) separating reaction products obtained in the immediately preceding subjecting step into lubricating oil and other byproducts.

In addition to the above described objects and advantages of the present invention, various other objects and advantages of the hydrogenation process for reprocessing used oil into secondary raffinates will become more readily apparent to those persons who are skilled in the art from the following more detailed description of the invention when such description is taken in conjunction with the attached drawing.

DESCRIPTION OF THE PREFERRED EMBODIMENTS

Prior to proceeding to the detailed description of the invention it should be noted that as used in the specification and claims the terms "used oils", "secondary raffinates", "removal of coarse solids", "hydrogenation in the sump phase" and "hydrogenation in the gas phase" are defined as follows, in the present invention:

Used oils are oils which, on account of the conditions caused by their previous use, can no longer function effectively for their original purpose. In addition to the foreign substances that are caused by natural wear and aging, the used oil may also contain one or more halogenated impurities as a contaminate.

Secondary raffinates are those products which, after performance of the hydrogenation process according to the invention and the possible addition of predetermined conventional additives, can be reused as a lubricating oil.

Removal of coarse solids, for effective performance of the hydrogenation process of the invention, it is necessary to free the used oil from such solid substances as cleaning rags, gloves, coarse metal shavings, etc., to substantially prevent interference with equipment, such as, for example, pumps and/or relief valves.

Hydrogenation in the sump phase means that during hydrogenation in the sump phase the used oil in the reaction chamber is in the liquid state.

Hydrogenation in the gas phase means a hydrogenation of the liquid and/or gaseous oils on a refining catalyst.

Figure 1:
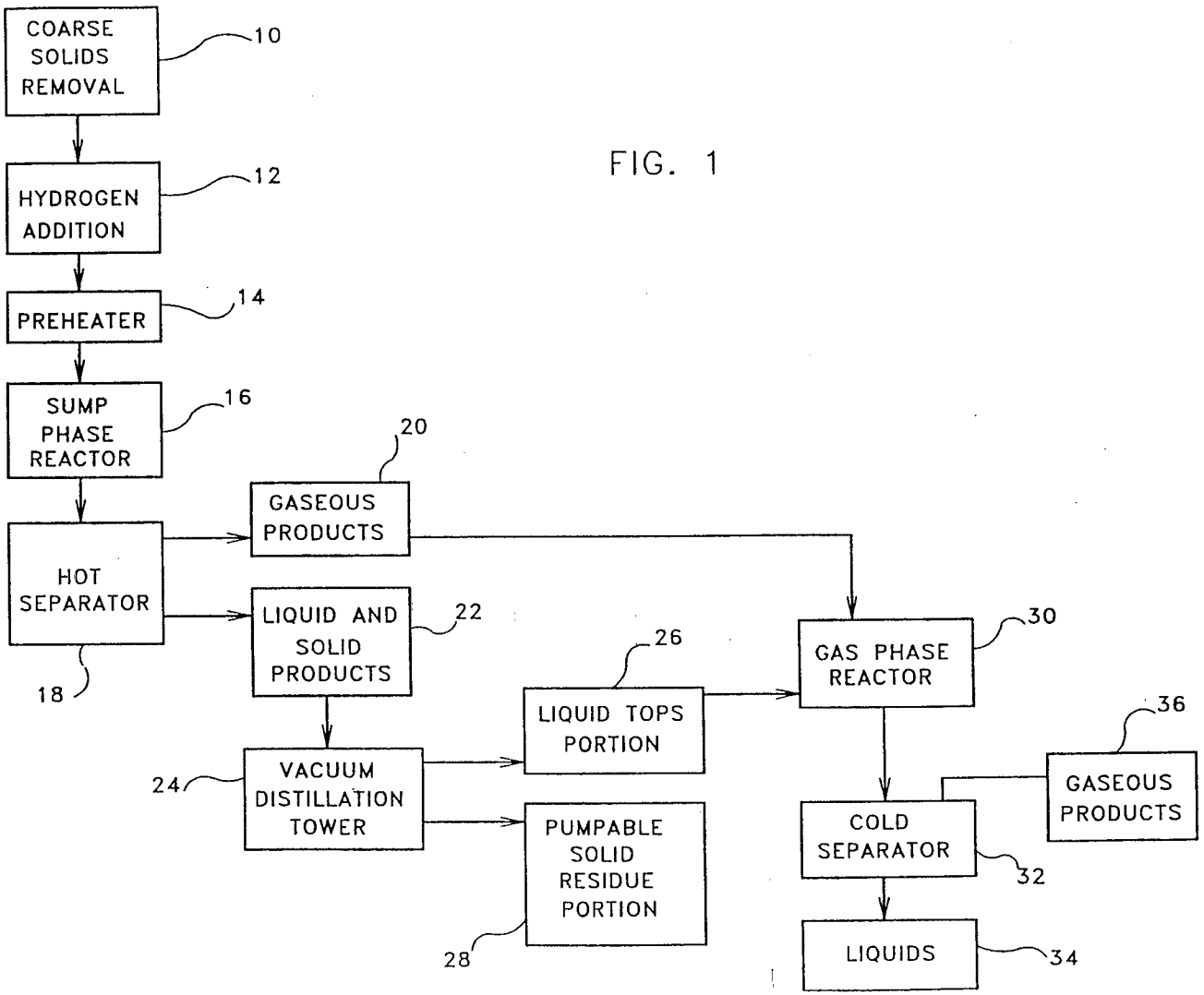
FIG. 1 is a schematic flow chart which illustrates a presently preferred embodiment of the instant invention.

The invention will now be explained with reference to the schematic flow chart illustrated in FIG. 1. The used oil is first subjected to a coarse solids removal step 10. Such coarse solids removal step 10 preferably includes a filteration step. Thereafter the hydrogenation process of this invention includes as a second step a hydrogen addition 12. After the hydrogen addition 12 the used oil is passed to a preheater 14 where the mixture to be hydrogenated is heated in the preheater 14 to a predetermined temperature. Such preheater 14 is operated at a predetermined pressure. After preheating to such predetermined temperature in the preheater 14 the used oil is then passed into a sump phase reactor 16. In the sump phase reactor 16 the used oil is then hydrogenated at a predetermined pressure and a predetermined temperature.

The reaction products obtained from the hydrogenation in the sump phase reactor 16 are then fed into a hot separator 18 where they are separated into gaseous, liquid and solid products. The gaseous products 20 are extracted from the top end of the hot separator 18 and the liquid and solid products 22 are extracted from the lower end of the hot separator 18 as the bottoms. The bottoms extracted from the hot separator 18 are then conducted to a vacuum distillation tower 24.

In the vacuum distillation tower 24 the bottoms extracted from the hot separator 18 are separated at predetermined temperatures and pressures into a liquid tops portion 26 and a pumpable solid residue portion 28 containing the solid matter. In this manner, the organochlorine compounds separated in the hydrogenation in the sump phase reactor 16 as chlorine and captured as sodium chloride, the additives contained in the used oil and the aging products present in such used oil are thereby separated. The tops or gaseous products 20 from the hot separator 18 and the liquid tops portion 26 from the vacuum distillation tower 24 are then conducted to a gas phase reactor 30 where they are hydrogenated therein at predetermined pressures and at predetermined temperatures. In the presently preferred embodiment of the invention a nickel/molybdenum catalyst on $Al_2O_3$ is used as the catalyst.

In a cold separator 32 positioned downstream from the gas phase reactor 30, the reaction product from the hydrogenation is separated into liquids 34 and gaseous components 36 at predetermined temperatures and predetermined pressures. The gaseous component 36 which is formed, preferably hydrogen, is recycled after gas purification to other parts of the process. The liquids 34 are depressurized and the product oil is extracted.

By way of example the above described process was operated as follows to reprocess a used oil which had an organo-chlorine content of about 0.6 wt.% was used together with a 3 wt.% Bayer compound as a catalyst, and about 2.7% $Na_2S$ (i.e. about 2 times the stoichiometric quantity) is used as a neutralizer. After the addition of 1,000 l of hydrogen per kg of used oil, the mixture to be hydrogenated was preheated in the preheater 14 to a temperature of about 350° C. at a pressure of about 150 bar before the mixture was fed to the sump phase reactor 16. The mixture was hydrogenated in the sump phase reactor 16 at a pressure of about 150 bar and at a temperature of about 350° C. The reaction products formed from the hydrogenation in the sump phase reactor 16 were then separated in the hot separator 18 in which the gaseous products 20 were extracted from the top end of such hot separator 18 and the liquid and solid products 22 were extracted as bottoms at the lower end of such hot separator 18.

The bottoms extracted from the hot separator 18 were then separated in the vacuum distillation tower 24, which was operated at temperatures of about 350° C. and pressures of about 20 mbar, into liquid tops 26 and a pumpable solid residue 28 which contained the solid matter. The gaseous products 20 from the hot separator 18 and the liquid tops 26 from the vacuum distillation tower 24 were then hydrogenated in the gas phase reactor 30 which was operated at a pressure of about 100 bar and at a temperature of about 350° C.

In a cold separator 32 located downstream of the gas phase reactor 30, the reaction product from the hydrogenation is separated into liquid and gaseous components at temperatures of approximately 300° C. and pressures of approximately 100 bar. The gas which is formed, that is preferably the hydrogen, is recycled after gas purification. The liquid phase is depressurized and the product oil is extracted.

In this manner, it is possible to obtain, from 1 kg of a used oil, 0.8 kg of a chlorine-free oil. Such chlorine-free oil can be used successfully as a lubricating oil after the addition of certain predetermined additives to it.

It can be seen from the above description of the invention that the objects are achieved by means of a hydrogenation process in which the used oil is first freed of coarse solid substances, and is then subjected to hydrogenation in a sump phase at pressures of between about 30 to about 300 bar, preferably at about 150 bar, and at temperatures of between about 200° to about 450° C., preferably about 350° C., and then a separation of the reaction products into the lubricating oil and other byproducts.

In one refinement of the invention, the hydrogenation is conducted in the sump phase, preferably in the presence of a weakly hydrogenation active catalyst. Such catalysts include in particular Fe catalysts, such as Bayer compound (red mud) or carrier materials that are saturated with iron salts.

If, according to another refinement of the present invention, the hydrogenation in the sump phase takes place with the addition of a neutralizer, in particular a sodium salt of a weak acid, such as, for example, sodium sulfide, even severely contaminated used oils, i.e. those containing a relatively high content of organo-chlorine compounds, can be processed into secondary raffinates in the form of lubricating oils. This can be accomplished in this invention without ecologically harmful or objectionable byproducts or waste products. The neutralizer is preferably added before the addition of the hydrogen, in particular together with a catalyst. Typical quantities of additives are in the range of from about one to about three times the stoichiometric quantity, in relation to the chlorine present in the used oil being reprocessed.

The separation of the reaction products of the hydrogenation in the sump phase into the lubricating oil, or a first light oil of the lubricating oil, on the one hand, and into byproducts on the other hand, takes place in the hot separator 18, in which the tops containing the gaseous products 20 are separated from the bottoms containing all of the liquid and solid products 22. Such hot separator 18 is generally operated at approximately 30° to 50° C. below the selected temperature in the sump phase reactor 16.

In still another refinement of the invention, the bottoms, i.e. the liquid and solid products 22, from the hot separator 18 are preferably distilled in the vacuum distillation tower 24. The residue obtained from such vacuum distillation tower 24 contains solids, in particular the catalyst and sodium chloride, which have been formed from the dechlorination of organo-chlorine compounds present in the used oil being processed. Surprisingly, it has been found, it is possible by utilization of this invention to substantially completely convert and separate the chlorine from particularly problematic organo-chlorine compounds such as, PCB, chlorinated dioxins and dibenzofurane into sodium chloride, which is altogether ecologically acceptable. The tops from both the vacuum distillation tower 24 and the hot separator 18 are preferably combined to obtain the lubricating oil. In this manner, enhanced recovery of lubricating oil is achieved.

A subsequent hydrogenation in the gas phase reactor 30, following the step in which the solid reaction products from hydrogenation in the sump phase reactor 16 are separated from the liquid reaction products, leads to an improvement in the quality of the secondary raffinates obtained in the form of lubricating oils. As mentioned above, in the sense of the present invention, the term "hydrogenation in the gas phase" means a hydrogenation of the liquid and/or gaseous oils on a refining catalyst. Nickel/molybdenum or cobalt/molybdenum catalysts are presently preferred as refining catalysts.

In summary, it can be seen from the detailed description provided above, the present invention provides a process for the hydrogenating reprocessing of used oil into secondary raffinates in the form of lubricating oils. In the invented process, ecologically undesirable byproducts and/or waste materials are virtually eliminated, without requiring expensive and time-consuming separation stages or reaction conditions. Furthermore, the use of expensive catalysts is not required to operate the process of the invention. In particular, the process of this invention can tolerate even severely contaminated oils, i.e., those oils which contain organo-chlorine compounds, in particular PCB, chlorinated dioxins and dibenzofurane in concentrations above certain limits, can also be reused as secondary raffinates, in particular as lubricating oils. This, for example, substantially eliminates the need for these substances to be destroyed in a high temperature combustion process.

One aspect of the invention resides broadly in a process for the hydrogenation reprocessing of used oils into secondary raffinates in the form of lubricating oils, with the addition of hydrogen, characterized by the fact that first, the coarse solid substances are removed from the used oil, and then the used oil is subjected to hydrogenation in a sump phase at pressures from 30 to 300 bar and temperatures from 200° to 450° C., after which the reaction products are separated into the lubricating oil and byproducts.

Another aspect of the invention resides broadly in a process characterized by the fact that the hydrogenation is conducted in the sump phase in the presence of a low hydrogenation active catalyst.

Yet another aspect of the invention resides broadly in a process characterized by the fact that the hydrogenation is conducted in the sump phase with the addition of a neutralizer.

A further aspect of the invention resides broadly in a process characterized by the fact that the reaction products from the hydrogenation in the sump phase are separated in a hot separator into bottoms containing liquids and solids, and gaseous tops.

A yet further aspect of the invention resides broadly in a process characterized by the fact that the bottoms are distilled in a vacuum tower.

Yet another aspect of the invention resides broadly in a process characterized by the fact that the tops from the vacuum tower and the hot separator are combined before the lubricating oil is obtained.

An additional aspect of the invention resides broadly in a process characterized by the fact that the liquid reaction products from the hydrogenation in the sump phase are hydrogenated in the gas phase at pressures from 50 to 200 bar and temperatures from 300° to 400° C. on refining catalysts.

A yet additional aspect of the invention resides broadly in a process characterized by the fact that nickel/molybdenum and cobalt/molybdenum catalysts are used as refining catalysts.

Embodiments of the invention may have the following characteristics or advantages:

the typical product characteristics of a lubricating oil are retained;

the process can also be used for the hydrogenation reprocessing of uncontaminated oils, without producing ecologically harmful or objectionable byproducts or harmful wastes, like those produced by the sulfuric acid-clay process;

so-called aging products of the oil can easily be removed from the used oil, along with additives, after the hydrogenation step in the sump phase;

the separation into residues and product oil, with the simultaneous use of relatively economical catalysts, is less expensive than processes of the prior art, e.g. the KTI process.

Some examples of red mud being used in catalytic processes are the following:

U.S. Pat. No. 4,017,425 entitled "Method of Activation of Red Mud";

U.S. Pat. No. 4,559,129 entitled "Red Mud as a First-stage Catalyst in a Two-stage, Close-coupled Thermal Catalytic Hydroconversion Process";

U.S. Pat. No. 4,559,130 entitled "Metals-impregnated Red Mud as a First-stage Catalyst in a Two-stage, Close-coupled Thermal Catalytic Hydroconversion Process"; and U.S. Pat. No. 4,464,479 entitled "Method for Treating Red Mud".

The above-cited documents are incorporated herein by reference as if they were set forth in their entirety herein.

Figure 2:
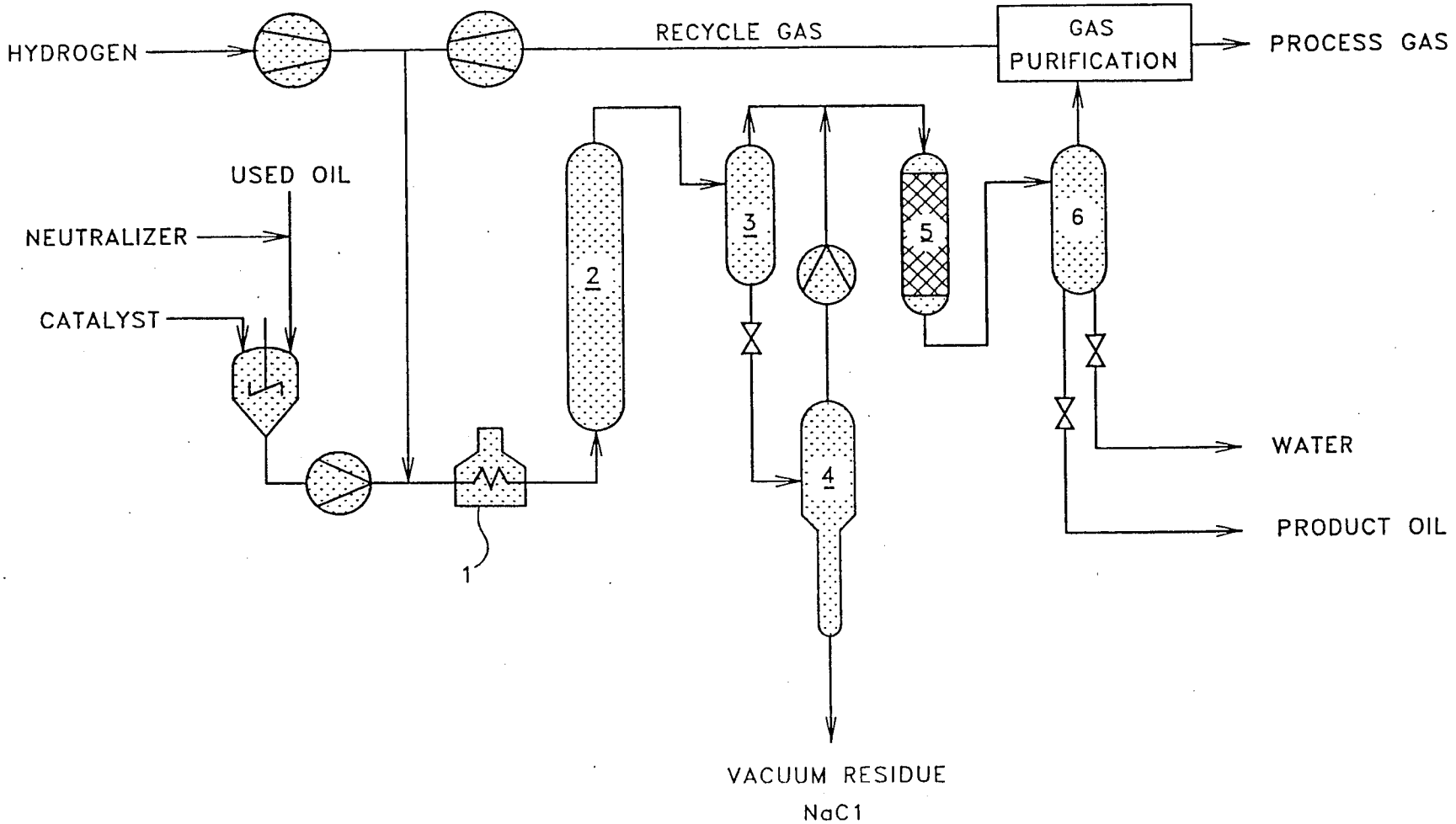
FIG. 2 is a schematic diagram which illustrates another preferred embodiment of the instant invention.

In summing up, now referring to FIG. 2, the used oil from which coarse solids have been removed, in particular by filtration, and which has an organo-chlorine content of 0.6 wt.%, is used together with 3 wt.% Bayer compound as catalyst, and 2.7% $Na_2S$ (2 times the stoichiometric quantity) is used as neutralizer. After the addition of 1000 l of hydrogen per kg of used oil, the mixture to be hydrogenated is heated in a pre-heater 1 to 350° C. at 150 bar before being fed into the sump phase reactor 2, and is then hydrogenated in the sump phase reactor 2 at 150 bar and 350° C.

The reaction products from the hydrogenation in the sump phase are separated in a hot separator 3, whereby the gaseous products are extracted from the top end of the hot separator 3, and the liquid and solid phase products are extracted as the bottoms at the lower end.

The bottoms extracted from the hot separator 3 are separated in a vacuum distillation tower 4 at temperatures of 350° C. and pressures of 20 mbar into liquid tops and a pumpable vacuum residue containing the solid matter. The organo-chloride compounds separated in the hydrogenation in the sump phase as chlorine and captured as sodium chloride, and the additives and aging products contained in the used oil are thereby separated. The tops from the hot separator 3 and the vacuum distillation tower 4 are then hydrogenated in a gas phase reactor 5 under the following operating conditions:

| | |
|---|---|
| Pressure | 100 bar |
| Temperature | 350° C. |

A nickel/molybdenum catalyst on $Al_2O_3$ is used as the catalyst.

In a cold separator 6 downstream of the gas phase reactor 5, the reaction product from the hydrogenation is separated into liquid and gaseous components at temperatures of approximately 300° C. and pressure of 100 bar. The gas which is formed, preferably hydrogen, is recycled after gas purification. The liquid phase is depressurized and the product oil is extracted.

In this manner, it is possible to obtain, from 1 kg of a used oil, 0.8 kg of a chlorine-free oil, which can be used as lubricating oil after the addition of additives.

The invention as described hereinabove in the context of a preferred embodiment is not to be taken as limited to all of the provided details thereof, since modifications and variations thereof may be made without departing from the spirit and scope of the invention.

What is claimed is:

1. A process for removing polycholorinated biphenyl from used oil to produce secondary raffinates, said used oil comprising at least one of: an oil, hydraulic fluid, cutting oil and electric transformer coolant oil, said process comprising the steps of:

(a) removing any coarse solid particles from said at least one of said oil, said hydraulic fluid, said cutting oil and said electric transformer coolant oil;

(b) adding hydrogen to said at least one of said oil, said hydraulic fluid, said cutting oil and said electric transformer coolant oil after step (a) to form a hydrogen rich mixture prior to carrying out steps (c) through (k);

(c) preheating said hydrogen rich mixture performed in step (b) to a temperature of about 350° C.;

(d) passing said hydrogen rich mixture preheated to said temperature of about 350° C. in step (c) to a sump phase reactor;

(e) hydrogenating said hydrogen rich mixture in said sump phase reactor at a pressure of about 150 bar and a temperature of about 350° C. to form a combination of reaction products;

(f) heating said reaction products formed in step (e) in a hot separator to a temperature of about 310° C.;

(g) separating said reaction products in said hot separator into gaseous, liquid and solid products;

(h) extracting said gaseous products from an upper portion of said hot separator;

(i) extracting said liquid and said solid products from a lower portion of said hot separator;

(j) passing said liquid and said solid products extracted from said hot separator in step (i) to a vacuum distillation tower;

(k) separating said liquid and said solid products at a temperature of about 350° C. and a pressure of about 20 mbar in said vacuum distillation tower into a liquid portion and a pumpable solids portion containing said polychlorinated biphenyl; and (l) combining said liquid portion from said vacuum distillation tower obtained in step (k) with said gaseous products from said upper portion of said hot separator obtained in step (h) to form said secondary raffinates, whereby about 80 percent of the used oil is recoverable as said secondary raffinates.

2. A hydrogenation process for reprocessing used oil into secondary raffinates, as recited in claim 1, wherein in step (e) said hydrogenation in said sump phase reactor is conducted with a presence of a low hydrogenation active catalyst.

3. A hydrogenation process for reprocessing used oil into secondary raffinates, as recited in claim 2, wherein said low hydrogenation active catalyst is selected from the group consisting of iron catalysts, carrier materials saturated with iron salts and mixtures thereof.

4. A hydrogenation process for reprocessing used oil into secondary raffinates, as recited in claim 3, wherein said iron catalyst is Bayer compound (red mud).

5. A hydrogenation process for reprocessing used oil into secondary raffinates, as recited in claim 1, wherein in step (e) said hydrogenation in said sump phase reactor is conducted with a presence of a neutralizer.

6. A hydrogenation process for reprocessing used oil into secondary raffinates, as recited in claim 5, wherein said neutralizer is a sodium salt of a weak acid.

7. A hydrogenation process for reprocessing used oil into secondary raffinates, as recited in claim 6, wherein said sodium salt of a weak acid is sodium sulfide.

8. A hydrogenation process for reprocessing used oil into secondary raffinates, as recited in claim 2, wherein in step (e) said hydrogenation in said sump phase reactor is conducted with a presence of a neutralizer and said low hydrogenation active catalyst and said neutralizer are added to said process substantially together.

9. A hydrogenation process for reprocessing used oil into secondary raffinates, as recited in claim 1, wherein said hot separator is operated at a temperature which is about 30° C. to 50° C. below said temperature of said sump phase reactor.

10. A hydrogenation process for reprocessing used oil into secondary raffinates, as recited in claim 1, wherein said process includes an additional step of combining said liquid tops portion from said vacuum distillation tower and said gaseous tops portion from said hot separator prior to obtaining said lubricating oil.

11. A hydrogenation process for reprocessing used oil into secondary raffinates, as recited in claim 1, wherein said secondary raffinates formed in step (l) are further hydrogenated in said gas phase reactor to form additional reaction products.

12. A hydrogenation process for reprocessing used oil into secondary raffinates, as recited in claim 11, wherein hydrogenation in said gas phase reactor is carried out on a refining catalyst.

13. A hydrogenation process for reprocessing used oil into secondary raffinates, as recited in claim 12, wherein said refining catalyst is selected from the group consisting of nickel/molybdenum, cobalt/molybdenum and mixtures thereof.

14. A hydrogenation process for reprocessing used oil into secondary raffinates, as recited in claim 11, wherein said sump phase reactor is operated at a pressure of between about 50 to about 200 bar and at a temperature of between about 200° to 400° C.

15. A hydrogenation process for reprocessing used oil into secondary raffinates, as recited in claim 1, wherein step (a) includes filtering said used oil to remove substantially all said coarse solid substances.

16. A hydrogenation process for reprocessing used oil into secondary raffinates, as recited in claim 10, wherein said process includes an additional step of adding additives to said secondary raffinates to form lubricating oils.

17. A hydrogenation process for reprocessing used oil into secondary raffinates, as recited in claim 4, wherein in step (e) said hydrogenation in said sump phase reactor is conducted with the presence of a neutralizer;

said neutralizer is a sodium salt of a weak acid; and said sodium salt of a weak acid is sodium sulphide.

18. A hydrogenation process for reprocessing used oil into secondary raffinates, as recited in claim 17, wherein in step (e) said active catalyst and said neutralizer are added to said process substantially together.

19. A hydrogenation process for reprocessing used oil into secondary raffinates, as recited in claim 18, wherein said hot separator is operated at a temperature which is about 30° C. to 50° C. below said temperature of said sump phase reactor.

20. A hydrogenation process for reprocessing used oil into secondary raffinates, as recited in claim 1, wherein said process includes an additional step of distilling in a vacuum distillation tower said liquid and solid products extracted from said lower portion of said hot separator.

21. A hydrogenation process for reprocessing used oil into secondary raffinates, as recited in claim 20, wherein:

said process includes an additional step of hydrogenating, in a gas phase reactor, at least a portion of a product obtained from said vacuum distillation tower after said liquid and solid products extracted from said lower portion of said hot separator are distilled in said vacuum distillation tower, and said hydrogenation in said gas phase reactor of said product obtained from said vacuum distillation tower is carried out on a refining catalyst in said gas phase reactor.

22. A hydrogenation process for reprocessing used oil into secondary raffinates, as recited in claim 21, wherein said refining catalyst is selected from the group consisting of nickel/molybdenum, colbolt/molybdenum and mixtures thereof.

23. A hydrogenation process for reprocessing used oil into secondary raffinates, as recited in claim 11, further including the step of separating said additional reaction products in a cold separator to form gaseous products and liquids.

* * * * *